US009125282B2

(12) United States Patent
Pollischansky

(10) Patent No.: US 9,125,282 B2
(45) Date of Patent: Sep. 1, 2015

(54) METHOD FOR ACTUATING A DISCHARGE LAMP AND CIRCUIT ARRANGEMENT FOR OPERATING SUCH A LAMP

(75) Inventor: Thomas Pollischansky, München (DE)

(73) Assignee: OSRAM GmbH, Munich (DE)

( * ) Notice: Subject to any disclaimer, the term of this patent is extended or adjusted under 35 U.S.C. 154(b) by 854 days.

(21) Appl. No.: 13/389,395

(22) PCT Filed: Jul. 23, 2010

(86) PCT No.: PCT/EP2010/060716

§ 371 (c)(1),
(2), (4) Date: Feb. 7, 2012

(87) PCT Pub. No.: WO2011/015468

PCT Pub. Date: Feb. 10, 2011

(65) Prior Publication Data

US 2012/0133297 A1 May 31, 2012

(30) Foreign Application Priority Data

Aug. 7, 2009 (DE) ..... 10 2009 036 645

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 41/295*** | (2006.01) |

(52) U.S. Cl.
CPC ..... *H05B 41/295* (2013.01)

(58) Field of Classification Search
CPC ..... H05B 33/0827; H05B 33/0896; H05B 37/00; G09G 3/3225; Y02B 20/36
USPC ..... 315/185 R, 185 S, 224, 307, 308, 291, 315/312, DIG. 7
See application file for complete search history.

(56) References Cited

U.S. PATENT DOCUMENTS

| | | | | |
|---|---|---|---|---|
| 5,345,148 | A | 9/1994 | Zeng et al. | |
| 5,973,455 | A * | 10/1999 | Mirskiy et al. | 315/105 |
| 5,986,408 | A * | 11/1999 | Langeslag et al. | 315/94 |
| 6,008,593 | A | 12/1999 | Ribarich | |

FOREIGN PATENT DOCUMENTS

| | | |
|---|---|---|
| DE | 198 05 733 | 8/1998 |
| EP | 1 991 033 | 11/2008 |
| GB | 2 264 596 | 9/1993 |

* cited by examiner

*Primary Examiner* — Hai L Nguyen
(74) *Attorney, Agent, or Firm* — Cozen O'Connor

(57) ABSTRACT

A method for actuating a discharge lamp (LP), wherein in order to ignite the lamp a resonant circuit (L, $C_1$) is brought into resonance or near resonance by the action of alternating current and as a result adjustment to give a predetermined amperage is performed by varying the frequency of the alternating current. For this purpose a measuring device transmits measured values of the amperage to means for controlling the frequency, and these means establish the frequency in dependence on the measured values. Before the ignition voltage is applied the electrodes of the lamp are pre-heated by the action on the resonant circuit of alternating current of a different frequency than when the lamp is ignited. During pre-heating a predetermined amperage is set by adjustment in that the means for controlling the frequency are already activated and the procedure is such that the measuring device obtains measured values of the amperage and transmits them to the means for controlling, these measurement values corresponding to an amperage which deviates in a predetermined manner from the amperage specified by measured values during ignition.

5 Claims, 4 Drawing Sheets

Figure 1:
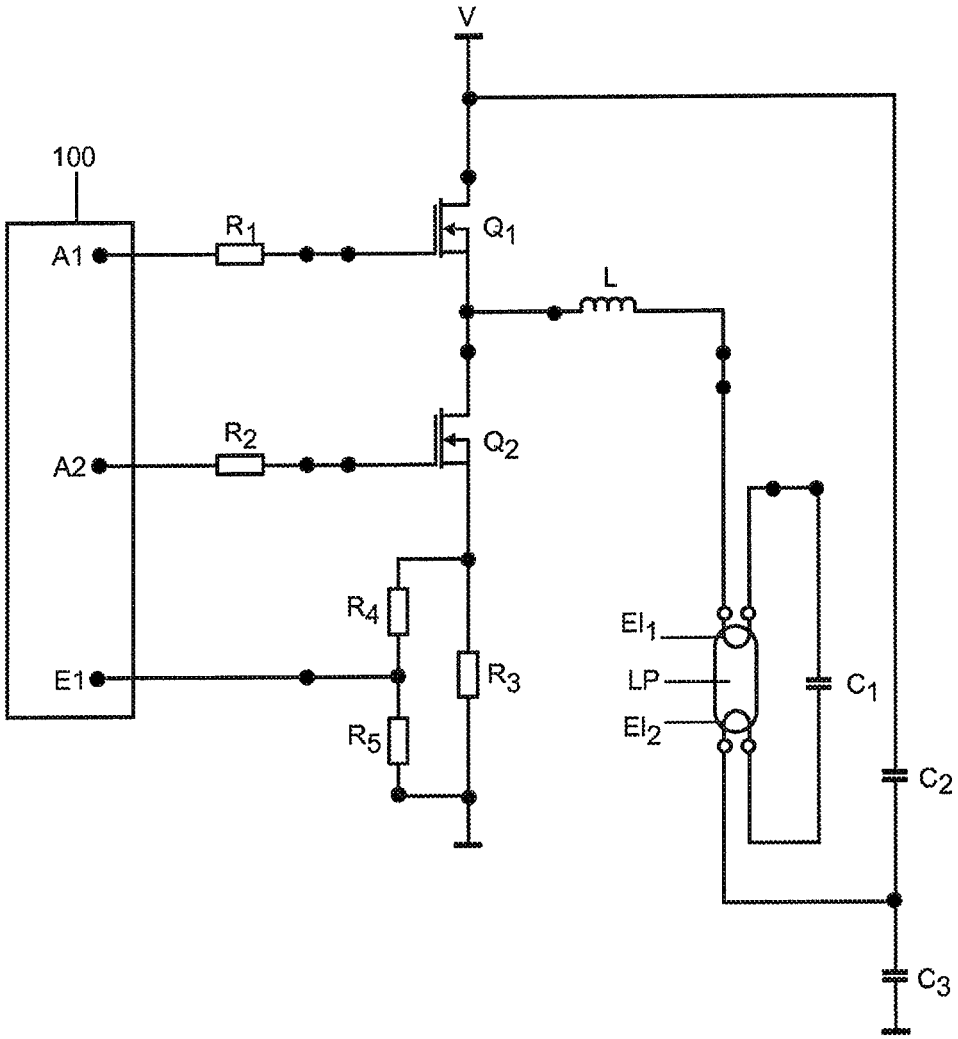
FIG 1 ( PRIOR ART )

METHOD FOR ACTUATING A DISCHARGE LAMP AND CIRCUIT ARRANGEMENT FOR OPERATING SUCH A LAMP

RELATED APPLICATIONS

This is a U.S. national stage of application No. PCT/EP2010/060716, filed on Jul. 23, 2010.

This application claims the priority of German application no. 10 2009 036 645.8 filed Aug. 7, 2009, the entire content of which is hereby incorporated by reference.

FIELD OF THE INVENTION

The invention relates to a method for actuating a discharge lamp. It also relates to a circuit arrangement for operating a discharge lamp.

BACKGROUND OF THE INVENTION

Known circuit arrangements for operating a discharge lamp include a resonant circuit, having a capacitive element which is connected in parallel with the discharge lamp and an inductive element which is in series upstream of the lamp and the capacitive element and downstream of a switching point between two switches. The switches, which typically take the form of MOSFETs, serve to apply current to the resonant circuit. Suitable means cause the two switches to be closed and opened again in a mutually alternating sequence, at predetermined switching frequency. Typically, the means for causing this include an application-specific integrated circuit (ASIC), which connects potential outputs with the control inputs of MOSFETs.

The purpose of the resonant circuit is to ensure that an ignition voltage is provided through the electrodes of the lamp, in other words in parallel with the capacitive element of the resonant circuit. To this end, a square voltage is applied over a half-bridge circuit to bring about oscillation or near resonance. So that the ignition voltage is set in defined manner, adjustment to give a predetermined amperage of the alternating current is performed by varying the frequency of the square voltage. To this end, means are provided in the circuit arrangement for measuring the amperage of a current flowing through one of the switches, and suitable means for establishing the switching frequency establish the latter during ignition as a function of the measured amperage.

Before the discharge lamp is ignited, the electrodes, which are typically in the form of coils, have to be pre-heated. Pre-heating is performed by providing heat from an ohmic loss by sending a current through the electrodes. This is also carried out in the circuit arrangement by triggering the switches and hence applying alternating current to the resonant circuit. In this case, however, the frequency is different from that used when the lamp is ignited.

In circuit arrangements that have been used hitherto, the frequency of the alternating current during pre-heating was established in advance by setting it to values above the resonant frequency of the resonant circuit.

The electrical parameters of electronic components may vary from one individual component to the next even if a nominal value is desirable per se. If the frequency during pre-heating is established in advance, as was the case hitherto, the pre-heating current that is set is highly sensitive to the parameters of the electronic components, in particular the capacitive element and the inductive element of the resonant circuit. It is then possible for a circuit arrangement to be rejected during production as not functioning adequately, even if all the components are individually functional per se and only deviations in the parameters are present in the components.

Adjustment of the pre-heating current is known in a number of circuit arrangements.

SUMMARY OF THE INVENTION

An object of the present invention is to provide a method which allows a discharge lamp to be actuated reliably even if there are deviations in the electrical parameters of the electronic components used therein. It is further an object of the present invention to provide a circuit arrangement for operating a discharge lamp, for igniting the lamp, and that functions as reliably as the circuit arrangement in its previously known construction but which at the same time makes reliable pre-heating possible.

According to an aspect of the invention, during pre-heating a predetermined amperage is also set by adjustment, in principle in the same way as during ignition, in that the means for controlling the frequency are already activated before the ignition procedure. Since adjustment is now to be to a different amperage, however, the procedure is such that the measuring device obtains measured values of the amperage and transmits them to the means for controlling the frequency, these measurement values corresponding to an amperage which deviates in a predetermined manner from the amperage measured during ignition. Thus, in a first situation the adjustment is performed on the basis of values measured for a first amperage and in a second situation the adjustment is performed using values measured for a second amperage, in each case for the same actual amperage. Preferably, following on from the methods of the prior art, the first situation is that of ignition, during which the actual amperage is mapped by the measured values in a predetermined manner. During pre-heating, the adjustment can then be performed on the basis of measured values which deviate in a predetermined manner from the actual amperage. Typically, the peak current value is measured. When this reaches a predetermined limit value the switching frequency of the half bridge is increased.

Thus, in particular during pre-heating, measurement of the amperage is deliberately falsified. In the simplest case, an offset is simply applied. In that case the regulating circuit causes an amperage to be actually set which is offset by this amount from what which would apply otherwise or during ignition.

An offset of this kind is approximately created in that a potential which is applied across a switching point during pre-heating is not applied during ignition.

In this way, it is possible to use the already known circuit arrangement which has the regulating circuit that is used when the lamp is ignited, and the same regulating circuit can then also be used to adjust the pre-heating current. This creates a synergy effect: a separate regulating circuit need not be provided for adjustment of the pre-heating current. A commercially available control ASIC which has no properties for adjusting the pre-heating current can regulate the pre-heating current using the circuit according to the invention.

In the case of the circuit arrangement, according to an aspect of the invention control means are provided for influencing the measured values obtained by the means for measuring, such that when an actuating program is executed the measured values can be influenced in this way at a suitable point in time, in particular during pre-heating.

Preferably, the control means include a source for providing a fixed potential (typically defined in relation to ground) across a switching point of the circuit arrangement. This may be, for example, an output for triggering pre-heating by transformer, by means of MOSFET switch. Alternatively, another output signal, which has a different potential during pre-heating from that in the other operating states, may, be used. This is for example the RTPH output in the Infineon control ASIC ICV1FL02G. By manipulating decreased voltages across resistors and hence currents that flow through these, the measured amperage is also manipulated, with an amperage that otherwise remains constant flowing through one of the switches.

Thus, a particular amperage may flow through one of the switches, and when the fixed potential is not present a first value for the amperage may be measured, and when the fixed current potential is present a second value for the amperage may be measured. This is precisely the objective of being able to use the electronics that set a predetermined amperage. In that case, by manipulating the measured values for the amperage the same regulating circuit may be used both during pre-heating and during ignition.

In a simple arrangement, the means for measuring the amperage include a voltage divider having two resistor elements. It is then sufficient for a switching point between the two resistor elements to be connected by way of a further resistor element to the source in order for the ratio between the decreased voltages across the two resistor elements to be changed. The further resistor element preferably has a resistance which is at least five times and preferably at least ten times as large as the largest resistance of the two resistor elements. The reason for this is to avoid generating excessively large additional currents but only to change the potential. The greater the resistance of the further resistor element, the greater the effect of a simple offset when measuring the amperage.

In the preferred embodiment, the circuit arrangement includes, as known per se from the prior art, an application-specific integrated circuit which includes two potential outputs for triggering the switches and a potential input which is part of the means for measuring and is connected for example to the switching point between the two resistor elements. It is within the scope of the invention to provide and use a third potential output which serves to provide the source.

Since some application-specific integrated circuits do not necessarily provide the ideal voltage source, in a preferred embodiment the third potential output is connected to ground by way of a Zener diode, in which case a capacitive element is preferably additionally connected in parallel therewith. In this case current flows from the potential output through the Zener diode, and the decreased voltage across this can be regarded as stable, such that a stable voltage source is provided, so this provides particularly good definition of the potential at the switching point of the circuit arrangement.

BRIEF DESCRIPTION OF THE DRAWING(S)

Figure 2:
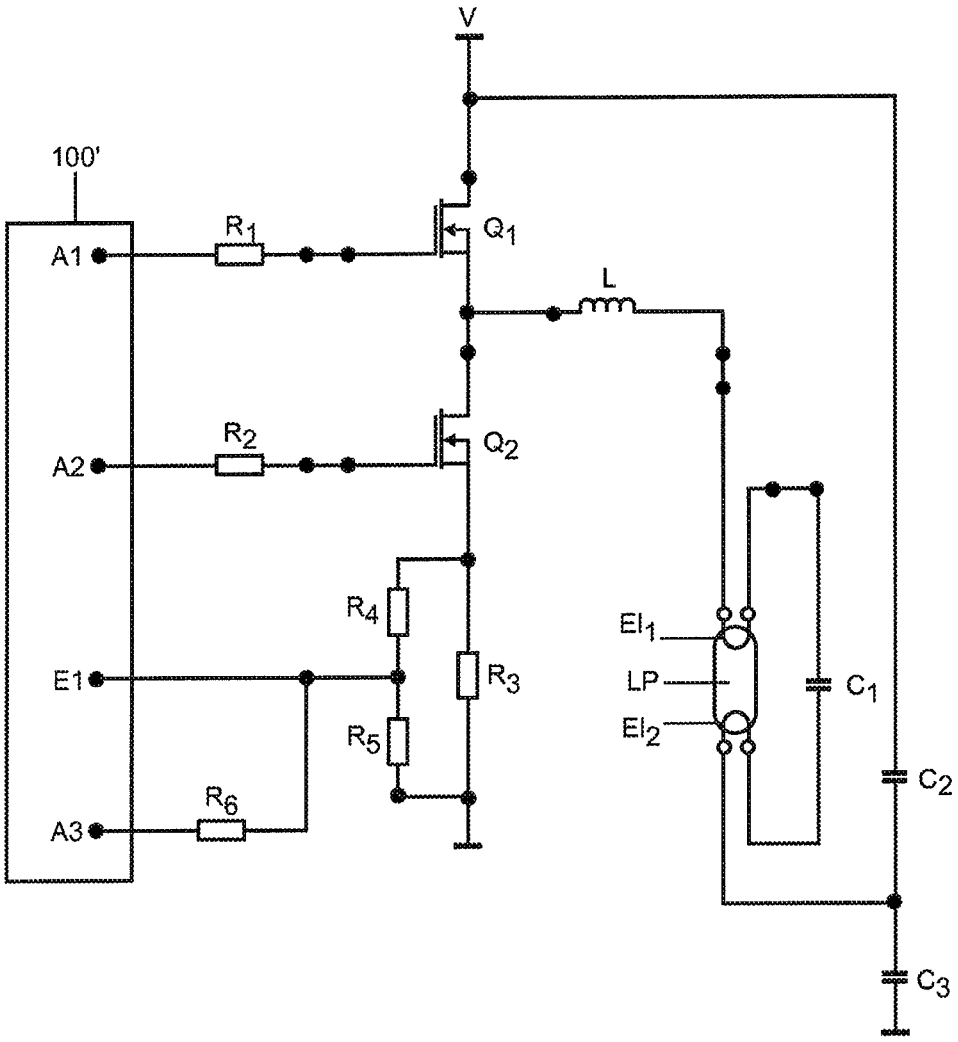
Figure 3:
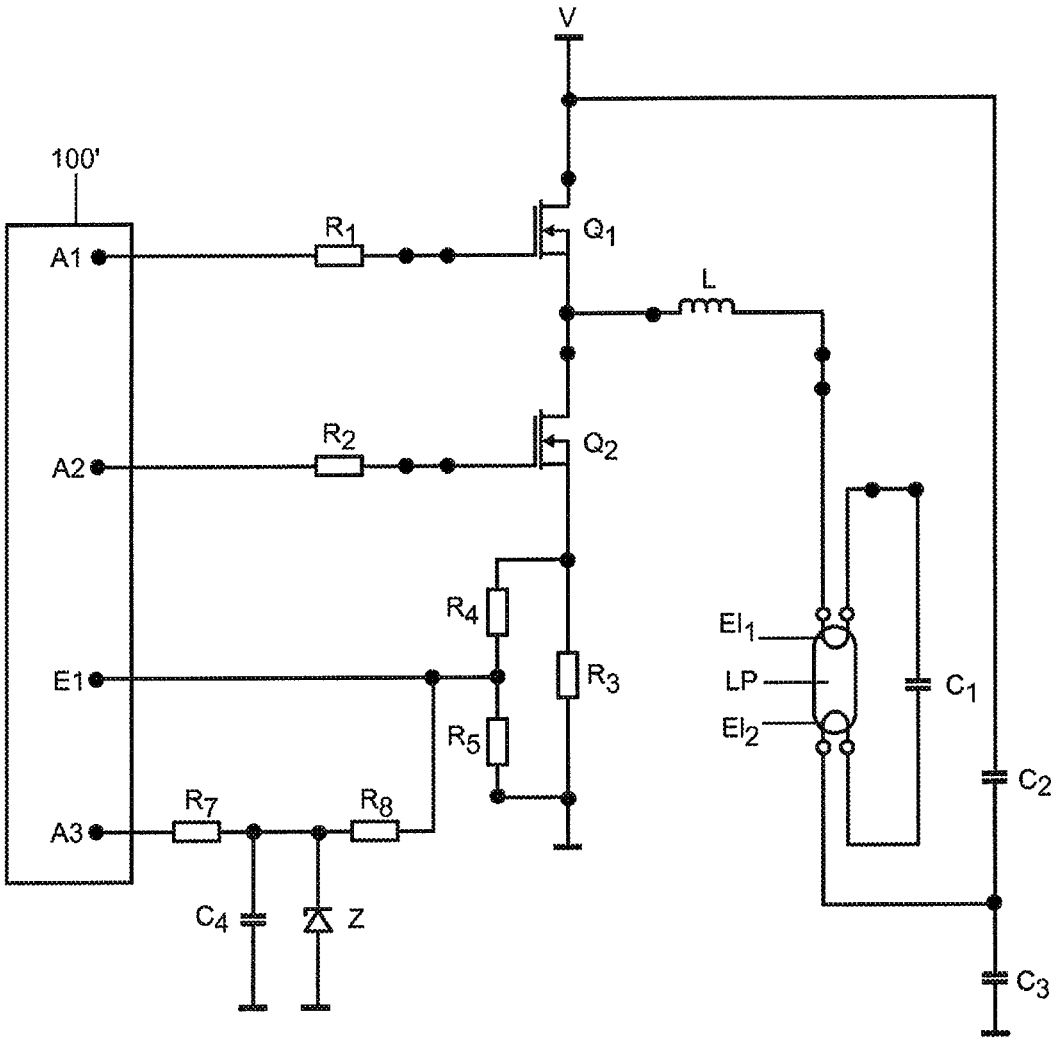
Figure 4:
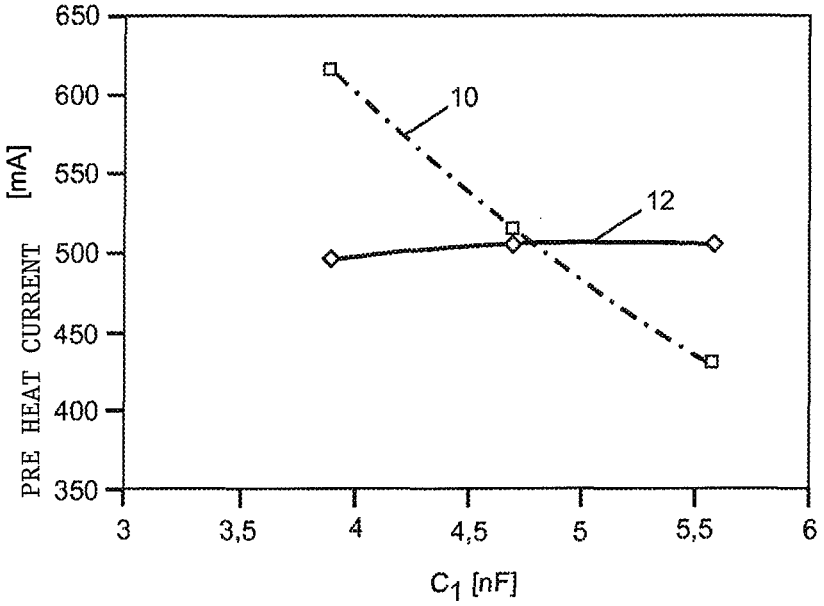

FIG. 1 shows the circuit diagram of a circuit arrangement for a discharge lamp according to the prior art, FIG. 2 shows a circuit diagram for a discharge lamp as implemented according to a first embodiment of the invention, FIG. 3 shows a circuit diagram for a discharge lamp as implemented according to a second embodiment of the invention, and FIG. 4 shows two graphs for illustrating the advantages of the invention over the prior art.

DETAILED DESCRIPTION OF THE DRAWINGS

A capacitive element $C_1$ is connected in parallel with a discharge lamp LP, for example a low-pressure discharge lamp. The two electrodes $El_1$ and $El_2$ of the lamp LP are connected to either side of a capacitor $C_1$. Connected in series with the lamp LP and hence also the capacitive element $C_1$ is an inductive element L. The electrode $El_2$ is connected to a potential V by way of a capacitive element $C_2$ and to ground by way of a capacitive element $C_3$. Two switches $Q_1$ and $Q_2$ which take the form of MOSFETs may connect the series circuit comprising the inductive element and the discharge lamp (or the capacitive element $C_1$) to the potential V (switch $Q_1$) or to ground (switch $Q_2$). The control inputs of the switches are connected to potential outputs A1, A2 of an application-specific integrated circuit 100 by way of resistor elements $R_1$ and $R_2$ respectively. Means provided in the circuit trigger the switches $Q_1$ and $Q_2$ in precisely alternating manner such that the capacitor $C_1$ is alternately charged from the potential V by way of the switch $Q_1$ and discharged to ground by way of the switch $Q_2$. Because the elements L and $C_1$ form a resonant circuit, the amperage of the current flowing through the electrodes $El_1$ and $El_2$ of the lamp LP can be adjusted with a high level of sensitivity. This is done by varying the frequency using suitable means in the integrated circuit 100.

The resonant circuit having the elements L and $C_1$ is used in particular when the discharge lamp LP is ignited. The resonant circuit is brought into resonance, or near resonance, such that extremely high voltages are applied between the electrodes $El_1$ and $El_2$, in order that the discharge lamp is ignited.

In this phase of ignition, it is important that predetermined and decreased voltages apply. For this purpose, the amperage is adjusted. The switch $Q_2$ connects the inductive element L to ground by way of a resistor element $R_3$. Provided in parallel with the resistor element $R_3$ is a voltage divider having the resistor elements $R_4$ and $R_5$, and the switching point between these two resistor elements $R_4$ and $R_5$ is connected to a potential input E1 of the application-specific integrated circuit. The potential input allows the decreased voltage across the resistor element $R_5$, and hence the amperage of the current flowing through the switch $Q_2$, to be measured. The frequency of opening and closing the switches $Q_1$ and $Q_2$ is determined in the application-specific integrated circuit 100 as a function of the voltage measured in this way. The value of the potential measured at the potential input, or the decreased voltage occurring in relation to ground, thus determines the output potentials at the potential outputs A1 and A2 and the frequency thereof.

Before ignition, the electrodes $El_1$ and $El_2$ have to be preheated. In the prior art, the adjustment which is used during ignition of the discharge lamp LP has not hitherto been used for this. Instead, a particular frequency for the amperage is provided in the application-specific integrated circuit 100, and this frequency acts on the outputs A1 and A2 during pre-heating. A particular alternating current is then established and is used as the pre-heating current.

The disadvantage here is that variation and fluctuations in the parameters of the capacitive element $C_1$ and the inductive element L are not taken into account. If for example the actual capacitance $C_1$ differs markedly from the setpoint value, the pre-heating current is falsified to a marked degree: FIG. 4 shows, by way of the curve 10, that for example if the capacitive element $C_1$ varies between 4 and 5.5 nF, the pre-heating current may vary between more than 600 and 425 mA. This variation is too great for practical applications.

In the invention, a further potential output A3 is provided which is connected by way of a resistor element $R_6$ to the switching point between the resistor elements $R_4$ and $R_5$ and hence ultimately to the potential input E1. If the resistor element $R_3$ has a resistance of 1 Ω and the resistor elements $R_4$ and $R_5$ each have a resistance of 1 kΩ, then $R_6$ should for example be selected to have a resistance of 10 kΩ. If a potential of 12 V in relation to ground is now applied across the potential output A3, when typically a decreased voltage of 2 V applies across the resistor elements $R_4$ and $R_5$, then an offset is produced in the potential at the switching point between the resistor elements $R_4$ and $R_5$. The threshold of adjustment for the current is reduced by this offset. The application-specific integrated circuit 100' is the same as the application-specific integrated circuit 100 with the additional use of the potential output A3. If, during pre-heating, a potential of 12 V is applied across the potential output A3, but in the interior of the application-specific integrated circuit 100' the potentials detected at the potential input El continue to be measured and the adjustment is made in dependence on these measured values, then on the basis of the offset in the measured values adjustment is made to give a different amperage than would be the case if the potential were not applied across the potential output A3.

Thus, by suitable selection of the potential at the potential output A3 and the resistor element $R_6$ to suit the resistor elements $R_4$ and $R_5$, the pre-heating current may adopt a defined ratio to the ignition current. During pre-heating, the potential is applied across the potential output A3 and then adjustment is performed to give a particular pre-heating current. During ignition, potential is no longer applied, so that the switching point between the resistor elements $R_4$ and $R_5$ remains unaffected. Then adjustment is made to give the ignition current in a manner known per se.

It can be seen from the curve 12 in FIG. 4 that, as a result of adjusting the pre-heating current, even when there are relatively large fluctuations in the value of the capacitance of the capacitive element $C_1$, almost the same pre-heating current flows constantly. This is precisely the desired effect. The components of the regulating circuit typically have a lower tolerance than the components L and $C_1$.

Unlike the embodiment according to FIG. 2, according to FIG. 3 it may be provided for an application-specific integrated circuit 100' which is not necessarily suitable as a voltage source to be used. In that case, the potential output A3 may be connected to ground, by way of a resistor element $R_7$ and a parallel arrangement comprising a Zener diode and a capacitive element $C_4$, and at the same time to the switching point between the resistor elements $R_4$ and $R_5$ by way of the resistor element $R_8$. When a potential is applied across the potential output A3, a current flows through the Zener diode Z and the decreased voltage across this is sufficiently stable for a kind of voltage source to be provided, and thus a fixed potential.

In the embodiments according to FIG. 2 and FIG. 3, the invention uses the intelligence of an application-specific integrated circuit as known from the prior art. In the prior art, this intelligence serves to adjust to give a particular amperage when the lamp LP is ignited. By extending the application-specific integrated circuit 100 to give the application-specific integrated circuit 100' and by means of the circuitry according to FIG. 2 or FIG. 3, this same intelligence may also be used to adjust to give a particular amperage during pre-heating.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit arrangement for operating a discharge lamp comprising:

a capacitive element which is connected in parallel with the discharge lamp and an inductive element which is in series upstream of the discharge lamp and the capacitive element, such that a resonant circuit is formed;

a plurality of switches for applying current to the resonant circuit;

means for closing each of the plurality of switches in a mutually alternating sequence at a switching frequency;

means for measuring an amperage of a current flowing through one switch of the plurality of switches;

means for establishing the switching frequency as a function of the measured amperage;

control means for influencing the measured values obtained by the means for measuring, said control means including a source for providing a fixed potential across a switching point of thc circuit arrangement; and an application-specific integrated circuit operatively coupled to the plurality of switches, said application-specific integrated circuit including a plurality of potential outputs for respectively triggering each of the plurality of switches, a potential input of the means for measuring and a third potential output for providing the source.

2. The circuit arrangement according to claim 1, wherein the means for measuring include a voltage divider having a plurality of resistor elements, and wherein said switching point being between each of the plurality of resistor elements and being connected via a further resistor element to the source.

3. The circuit arrangement according to claim 2, wherein the further resistor element has a resistance which is at least five times as large as the largest resistance of the plurality of resistor elements.

4. The circuit arrangement according to claim 1, wherein the third potential output is connected to ground via a resistor, a Zener diode.

5. The circuit arrangement according to claim 4, wherein the third potential output is further connected to ground via a capacitive element connected in parallel with the Zener diode.

* * * * *